United States Patent [19]

Lake et al.

[11] 4,422,410

[45] Dec. 27, 1983

[54] DOMESTIC COMBUSTION APPLIANCES

[75] Inventors: John M. Lake, Woodmancote; Robert C. Payne, Bishop Cleeve Nr. Cheltenham, both of England

[73] Assignee: Coal Industry (Patents) Limited, London, England

[21] Appl. No.: 431,198

[22] Filed: Sep. 30, 1982

Related U.S. Application Data

[63] Continuation of Ser. No. 249,960, Apr. 1, 1981, abandoned.

[30] Foreign Application Priority Data

Apr. 22, 1980 [GB] United Kingdom ..... 8013281

[51] Int. Cl.[3] ..... F22B 1/02; F22B 31/04

[52] U.S. Cl. ..... 122/4 D; 122/2; 122/22; 122/13 R; 122/13 A

[58] Field of Search ..... 122/4 D, 2, 22, 13 A, 122/13 R; 219/368, 378

[56] References Cited

U.S. PATENT DOCUMENTS

| | | | |
|---|---|---|---|
| 2,399,871 | 5/1946 | Johansson | 122/7 R |
| 2,670,425 | 2/1954 | Stone | 219/378 |
| 3,223,074 | 12/1965 | Tanner et al. | 122/2 |
| 3,250,521 | 5/1966 | Sergent | 219/365 |
| 3,902,462 | 9/1975 | Bryers | 122/4 D |
| 4,183,308 | 1/1980 | Toth | 122/4 D |
| 4,184,438 | 1/1980 | Bryers et al. | 122/4 D |
| 4,206,723 | 6/1980 | Kunkel | 122/22 |
| 4,253,425 | 3/1981 | Gamble et al. | 122/4 D |
| 4,296,711 | 10/1981 | Bilberg | 122/2 |
| 4,296,712 | 10/1981 | Vogt | 122/22 |

FOREIGN PATENT DOCUMENTS

| | | | |
|---|---|---|---|
| 2825600 | 1/1979 | Fed. Rep. of Germany | 122/4 D |
| 1513795 | 6/1978 | United Kingdom | 122/4 D |

*Primary Examiner*—Henry C. Yuen

*Attorney, Agent, or Firm*—Stevens, Davis, Miller & Mosher

[57] ABSTRACT

A domestic combustion appliance 1 has a body 2 having a distributor plate 14 for supporting a shallow fluidized bed 32. A primary boiler 34 forms part of a rear bounding wall for the fluidized bed 32, and a secondary boiler 50 is located downstream providing flue passages for exhaust gases. A window 10 is provided in the front wall 8 to give a visual effect for volatiles burning, in use, above the bed 32.

2 Claims, 1 Drawing Figure

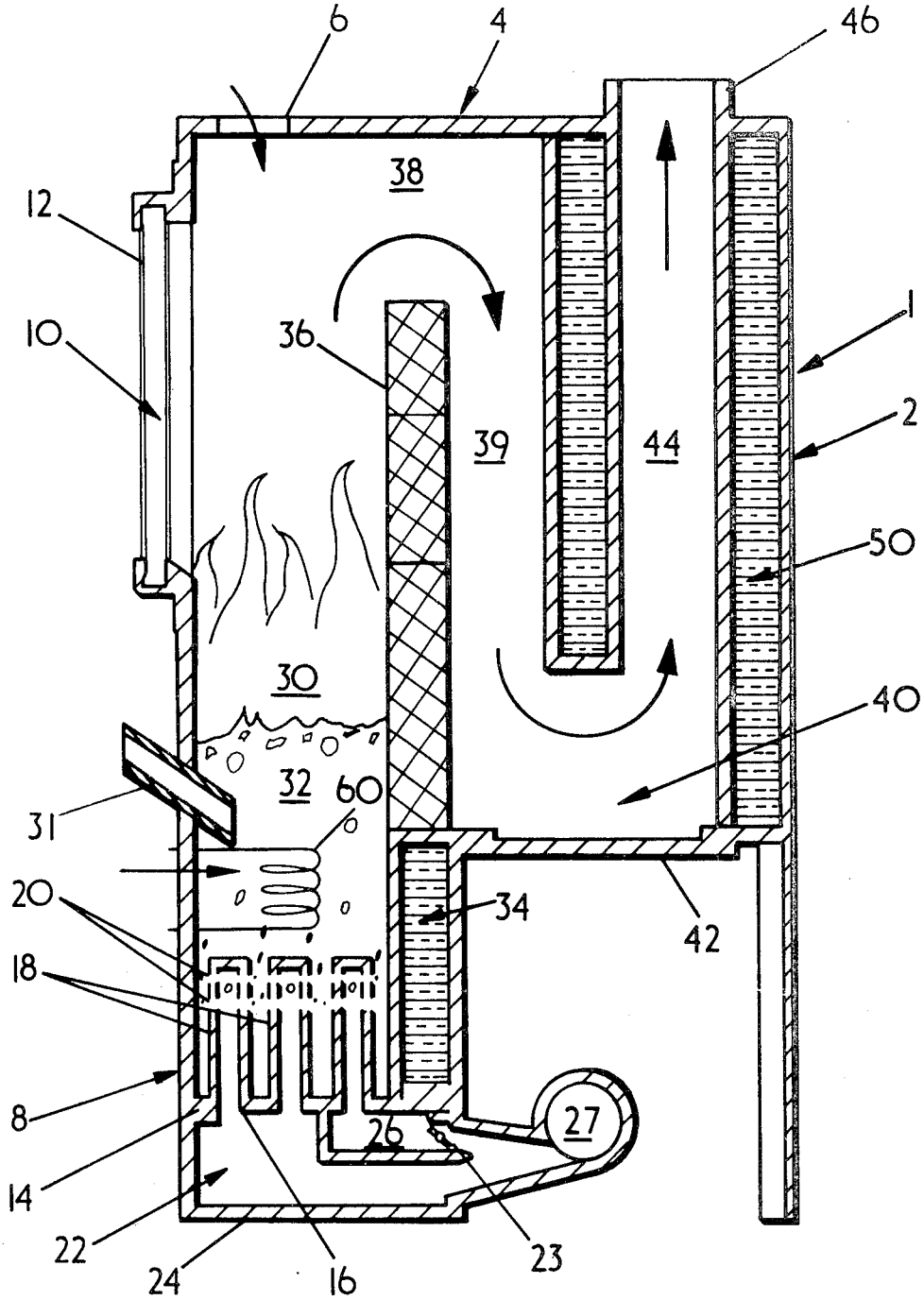
6
4
46
38
12
10
36
1
2
39
44
50
30
40
32
60
31
20
34
42
18
8
27
26
14
22
24
16
23

DOMESTIC COMBUSTION APPLIANCES

This is a continuation of application Ser. No. 249,960, filed Apr. 1, 1981, now abandoned.

This invention concerns improvements in or relating to domestic combustion appliances.

In particular, the present invention has reference to such appliances incorporating boilers for providing hot water for domestic use or in central heating systems. Hitherto, such appliances have generally been designed to employ, in use, solid fuel in a fixed bed supported on a grate, up draught or down draught combustion air being supplied as necessary naturally or mechanically.

An object of the present invention is to provide an improved domestic combustion appliance.

Accordingly the invention provides a domestic combustion appliance including a body, an air permeable support for supporting a fluidized bed of particulate material in a combustion zone above the support, a heat exchanger located adjacent the combustion zone, and a fan for supplying air through the support.

The support may conveniently comprise a plate having a number of standpipes perforated towards their upper ends. The support may alternatively be constituted of ceramic and be either of unitary construction or compound of a plurality of tiles. A plenum chamber is defined beneath the support and may advantageously be compartmented in such manner that air can in use, be directed to one or more compartments while being prevented from reaching others. This arrangement assists during start-up of the fluidized bed in that the part of the bed in contact with the heat exchanger can remain slumped such that heat transfer does not occur, thereby enabling swifter start-up.

Preferably, the heat exchanger is in the form of a primary boiler in direct contact with and forming a part of a rear bounding wall for the fluidized bed.

The front of the body constitutes the forward boundary for the fluidized bed and may have a section of transparent material for visual effect. The section is a window formed of glass tubes which transmit the light of volatiles, in use, burning above the bed.

A refractory wall upstands from the top of the heat exchanger and terminates short of the top of the appliance body thus providing a path for combustion products issuing from the fluidized bed. Flue passages extend to the rear of the wall and are designed to afford a tortuous path for the products and in use, particulates entrained in the products tend to drop out at the base of the flue passages, which are at least partially defined by heat exchange surfaces constituting a secondary boiler.

The top of the appliance body is provided with a fuel inlet and an electric heater may be located in the combustion zone for start-up ignition.

By way of example only, one form of domestic combustion appliance according to the invention is described below with reference to the accompanying drawing which is a diagrammatic side sectional view of the appliance.

Referring to the drawing, a domestic combustion appliance is shown at 1 and includes a body 2 having a top 4 provided with a fuel opening 6, and a front wall 8 which is formed partly by a window 10 of glass tubes 12. Sidewalls of refractory (not shown) are provided. Within a lower part of the body 2 is disposed a support plate 14 having apertures 16 in which are secured stand pipes 18 provided with perforations 20 near their upper ends. A plenum chamber 22 is defined between the plate 14 and the base 24 of the body and is divided towards the rear thereof to give a rear compartment 26. A fan 27 is coupled to the chamber 22 and a damper 23 is provided for the rear compartment 26.

A combustion zone 30 extends above the plate 14 and in use contains a shallow fluidized bed 32 of light weight material. The rear limit of the bed 32 is defined by a primary boiler 34, the rear compartment 26 of the plenum chamber 22 corresponding to an area of the plate 14 immediately adjacent the boiler 34. A refractory wall 36 extends from the top of the boiler 34 and terminates short of the top 4 of the appliance body 2 to provide a path 38 for combustion products. To the rear of the wall 36 is a first flue passage 39 leading to a drop out zone 40 provided with an access door 42. A second flue passage 44 extends upwardly from the zone 40 to an exhaust outlet 46, the passages 38, 44 being defined by heat exchangers 48 constituting a second boiler 50.

In use, a bed 32 of inert particulate material is formed in the combustion zone 30 and is raised to an appropriate temperature; for example 650° C. This increase in temperature can be achieved by blowing hot gas to the surface of the bed, by passing hot gas through the bed or by immersing an electric element in the bed. In the specific example, an electric element 60 is disposed in the zone 30 and actuated to heat the material while fluidizing air from fan 27 is passed upwardly through the bed 32 except through the rear compartment 26 of the chamber 22 which is closed off by means of the damper 23, thereby maintaining the bed 32 in the vicinity of the boiler 34 in a slumped condition so reducing heat output during start-up. The electric element 60 can also be employed for recovering the bed from a slumped position.

Once the temperature of the bed has reached the appropriate level, coal feed through the opening 6 is initiated and is actuated as required according to the bed temperature parameter, a controller (not shown) being provided for this purpose and employed in conjunction with a water or room temperature thermostat (not shown). The damper 23 is opened and the whole of the bed 32 is fluidized. The appliance can then be operated on an on/off basis.

Coal is burnt at about 800° C. to 900° C. in the bed 32, which may typically be 8" long×4½" wide×3" deep, and the combustion products issue from the top of the bed to pass through path 38 into the first flue passage 39 to flow downwardly whereupon they have to turn through 180° to pass into the second flue passage 44. In so doing particulate material, ash, elutriated from the bed 32 tends to drop out in the zone 40; this material can be periodically removed through the door 42. Volatiles are burnt in the freeboard above the bed 32 and this provides a visual aspect that can be seen through the window 10.

In order to enhance the combustion of volatiles, some air can be introduced through an inlet 31 at low pressure into the bed itself, thus reducing the back pressure in the bed thereby enabling a smaller fan to be employed.

The present invention thus provides an improved domestic combustion appliance having a shallow fluidized bed, for example 3" deep, giving efficient combustion using bituminous fuel with substantially smokeless operation. Fuel feed can be automatic as can de-ashing, start-up and on/off control of output. Operator attention would only be required for filling the fuel hopper (not shown).

I claim:

1. A fluidized bed domestic combustion appliance comprising an upstanding body, an air permeable support horizontally within the body defining a plenum chamber below the support and a compartmented combustion zone above the support; said support having a plurality of apertures with standpipes located in the apertures and perforations in the standpipes leading toward said combustion zone;

said combustion zone having a fluidized bed of particulate material immediately above said support and standpipe, an electric heater centrally positioned and immersed in a front portion of said fluidized bed; a primary boiler located adjacent a rear portion of said fluidized bed;

means for introducing air into the combustion zone above the support;

flue passages downstream of the combustion zone comprising a generally vertical downwardly extending open passage connected to the top of the combustion zone, a particulate matter drop-out zone at the base of said vertical passage, a further flue opening outwardly therefrom, and a secondary boiler in one of the walls of said flue passages;

said plenum chamber having fan means for inducing an air flow through the air permeable support, closure means for blocking off air flow to said rear portion of the fluidized bed, means to simultaneously actuate the electric heater and to close the closure means so that during start-up when the electric heater is bringing the front portion of the fluidized bed up to operating temperature, the rear portion of the fluidized bed can be kept at a lower temperature to avoid heat loss to the primary boiler.

2. An appliance according to claim 1 in which the body has a front wall, a part of which incorporates a transparent window.

* * * * *